US005478624A

United States Patent [19]

Lofquist

[11] Patent Number: 5,478,624

[45] Date of Patent: Dec. 26, 1995

[54] SYNTHETIC YARN WITH HEAT-ACTIVATED BINDER FIBER

[75] Inventor: Robert A. Lofquist, Richmond, Va.

[73] Assignee: AlliedSignal Inc., Morris Township, Morris County, N.J.

[21] Appl. No.: 389,428

[22] Filed: Feb. 14, 1995

Related U.S. Application Data

[63] Continuation of Ser. No. 286,896, Aug. 8, 1994, abandoned, which is a continuation of Ser. No. 960,751, Oct. 14, 1992, abandoned.

[51] Int. Cl.[6] ..... D02G 3/40; D03D 27/12; D05C 17/02

[52] U.S. Cl. ..... 428/97; 26/8 R; 28/214; 57/236; 57/255; 57/282; 139/399

[58] Field of Search ..... 26/8 R; 28/214; 57/236, 255, 282; 139/399; 428/297

[56] References Cited

U.S. PATENT DOCUMENTS 2,252,999 8/1941 Wallach .
3,494,819 2/1970 McAllister .
3,915,912 10/1975 Ishicawa et al. .
3,978,267 8/1976 Selwood .
4,225,699 9/1980 Schmid et al. .

FOREIGN PATENT DOCUMENTS 324773 11/1986 European Pat. Off. .
1168404 10/1969 United Kingdom .

*Primary Examiner*—James C. Cannon
*Attorney, Agent, or Firm*—Melanie L. Brown; Roger H. Criss

[57] ABSTRACT

A synthetic yarn made from a blend of base fibers selected from the group consisting of polyester, nylon 6 and nylon 66, and 1–12 weight percent of a heat activated binder fiber having a melting point within the range of 165°–190° C., said binder fiber being made from a copolyamide which is derived from a mixture of 50 to 85 wt. % caprolactam, 0 to 40 wt. % hexamethylenediamine adipate or a combination of hexamethylenediamine and adipic acid, and optionally a salt selected from the group consisting of hexamethylenediamine dodecanedioate, hexamethylenediamine azeleate, hexamethylenediamine sebacate and hexamethylenediamine terephthalate; and a chain terminator selected from at least one of the group consisting of a fatty acid and a fatty amines, wherein said fatty acid or fatty amine include at least 14 carbon atoms. The binder fiber is capable of being pelletized into chips, leached and spun into yarn on a package without any significant sticking either of the chips to one another or the yarn on the package.

19 Claims, No Drawings

SYNTHETIC YARN WITH HEAT-ACTIVATED BINDER FIBER

This application is a continuation of application Ser. No. 08/286,896 filed Aug. 8, 1994, now abandoned, which is a continuation of Ser. No. 078/960,751 filed Oct. 14, 1992, now abandoned.

FIELD OF THE INVENTION

This invention relates to synthetic yarn for carpet face fiber and other applications, the yarn comprising a blend of fibers including a first synthetic base fiber and a second heat-activated adhesive fiber with a melting point substantially below that of the first synthetic base fiber. In a process for production of carpet, exposure of the yarn to usual process conditions for twist setting the yarn causes the heat-activated adhesive fiber to melt substantially completely, losing its identity as a fiber, and to flow to points of intersecting base fibers to create a bond upon subsequent cooling, thus altering properties and performance of the resulting product.

DESCRIPTION OF RELATED ART

It is known (see U.S. Pat. No. 2,252,999 to Wallach, issued Aug. 19, 1941, and U.S. Pat. No. 3,877,214 to Van der Werf, issued Apr. 15, 1975) to blend non-adhesive fibers with potentially adhesive fibers to form a yarn or other textile structure, then to activate the potentially adhesive fibers to bond them to contacting fibers, thus modifying end-use properties of the yarn. U.S. Pat. No. 3,494,819 to McAlister, issued Feb. 10, 1979, discloses a blend of fusible and non-fusible polyethylene terephthalate fibers incorporated into fabric, wherein the finished fabric is heated to fusion temperatures to provide improved pill resistance. U.S. Pat. No. 3,978,267 to Selwood, issued Aug. 31, 1976 discloses an adhesive fiber to bond to contacting fibers.

European Patent 324,773 assigned to Allied-Signal, discloses a synthetic yarn comprising a blend of base fibers selected from the group consisting of polyester, nylon 6 and nylon 6,6, and 1–12 weight percent preferably 1–8 weight percent, of a heat-active binder fiber with a melting point within a range of 110° to 170° C., preferably 130° to 160° C. A copolyamide fiber within the specified melting point range is described generally as the preferred binder fiber, with copolyamides of the 6/66/12 type being the only exemplified binder fiber. U.S. Pat. No. 4,225,699, column 2, lines 13–18, cites British Patent 1,325,778 as describing applying compounds containing long paraffin chains, such as lauric acid, etc., to copolyamide chips. Belgium Patent 691,700 gives a summary of many published patents specifications from Japan, Great Britain and the United States relating generally to this subject matter. U.S. Pat. No. 3,915,912 issued Oct. 28, 1975, describes an antistatic yarn made from a polyamide modified to include polyethylene glycol whose yarn-to-yarn adhesion is decreased by the addition of 0.01 to 2% of specified additives including long chain fatty acids having at least 11 carbon atoms such as lauric acid, stearic acid, and behenic acid.

Cut-pile carpet is customarily produced from staple yarns or bulked continuous filament yarn. For example, staple fiber is conventionally carded, pinned, and spun or wrap spun into a singles yarn, which typically is twisted and plyed with similar yarn to form a 2-ply or 3-ply yarn construction. This yarn is twist set by utilizing one of several commercially available twist setting processes such as the Suessen or Superba processes.

In a typical process the yarn is passed through a heated chamber while in a relaxed condition. The temperature of this process step is crucial to the proper twist setting of the base fiber, to obtain desired properties of the final carpet product. For nylon-6 base fiber, the conditions for this step are typically 195°–200° C. with a residence time of about 60 seconds for the Suessen process and about 135°–140° C. with a residence time of about 60 seconds for the Superba process. The Superba process utilizes saturated steam and thus the yarn is subjected to a much higher level of humidity than in the Suessen process.

Similarly, bulked continuous filament nylon yarn is produced according to various conventional methods. Twisting, entangling, or direct cabling may be utilized in various processes. For example, a 2-ply twisted yarn combining 2 ends of 1185 denier 70 filament yarn is prepared and subjected to conventional twist setting conditions, such as that for the staple yarn above or in an autoclave at 132° C. in saturated steam, with a residence time of about 60 seconds.

Multiple ends of the twist set yarns are tufted into cut pile carpet and conventionally finished to obtain the desired carpet product.

SUMMARY OF THE INVENTION

There is provided according to this invention a synthetic yarn comprising a blend of base fiber selected from the group consisting of polyester, nylon 6 and nylon 66, and 1–12 weight percent, preferably 1–8 weight percent, of a heat-activated binder fiber with a melting point within the range of 165°–190° C., preferably 170°–185° C., said binder fiber comprising a copolyamide having a melting point within the specified range and being derived from 50 to 85, preferably 60 to 85, wt. % caprolactam, 0 to 40, preferably 15 to 40, wt. % hexamethylenediamine adipate or a blend of hexamethylene diamine and adipic acid, and optionally 5 to 50 wt. % of a third component selected from the group consisting of hexamethylenediamine dodecanedioate, a blend of hexamethylene diamine and dodecanedioc acid, hexamethylenediamine azeleate, a blend of hexamethylene diamine and azelaic acid, hexamethylenediamine sebacate, a blend of hexamethylene diamine and sebacic acid, hexamethylenediamine terephthalate, and a blend of hexamethylene diamine and terephthalic acid, in combination with a chain terminator selected from one or more of the group consisting of long chain fatty acids and long chain fatty amines having at least 14 carbon atoms, wherein said copolyamide can be pelletized into chips, leached and spun into yarn onto a package without any significant sticking of either the chips to each other or the yarn on the package. When the yarn is twisted, plyed and twist set by conventional processes, for example 195° C. for a residence time of about 60 seconds, and the treated yarn tufted into cut-pile carpet, the resulting carpet displays enhanced carpet tuft appearance, improved resilience, and reduced change of appearance with use.

DETAILED DESCRIPTION OF THE PREFERRED EMBODIMENTS

As mentioned previously, European Patent 324,773 discloses a yarn comprising a base fiber and a 6/66/12 copolyamide binder fiber. A problem was found to exist, however, when the major component of the 6/66/12 copolyamide constituted less than 85 wt. % of the total weight of the copolyamide. In this case, the copolyamide has an increased tendency to absorb moisture which in turn tends to increase the adhesion of pellets, fibers and yarns that include this copolyamide to each other. This is a particularly troublesome problem in the context of the use of a binder fiber since the binder fiber must be uniformly blended with the base fiber. It has been discovered that the blending of the binder fiber and the base fiber is improved significantly if a long chain fatty acid and/or long chain fatty amine having at least 14 carbon atoms is used as the chain terminator during the polymerization of the components that form the copolyamide of the binder fiber.

The base fiber is selected from known synthetic fiber suitable for carpet use. Preferred base fiber includes polyamide, particularly nylon 6 and nylon 66, and polyester, particularly poly(ethylene terephthalate).

The binder fiber has a melting point range of 165°–190° C., preferably 170°–185° C., under ambient humidity conditions and will provide adequate adhesive properties during any subsequent dyeing steps and final use. A saturated steam environment, such as in the Superba process, reduces the binder fiber melting point to 130°–140° C.

The binder fiber can be cut into staple and blended with base staple fiber and the resulting staple fiber blend can then be processed in known ways. It is important to insure a thorough blending to avoid potential clumps in the finished carpet. The reduced adhesion of the binder staple fiber according to the invention allows for a more thorough blending. The staple fiber blend should contain 1–12 weight percent binder fiber, preferably 1–8 weight percent. Higher amounts cause undesirable harshness of hand due to the conditions of the twist setting process causing the binder fiber to melt substantially completely. Spun yarns prepared from such a staple fiber blend and subjected to thermal activation can provide strength properties approaching that of bulked continuous filament (BCF) yarns.

The binder fiber can also be continuous filament and blended with bulk continuous filament base fiber (BCF) via conventional means such as commingling. According to a preferred method for commingling the binder fiber, a set or rolls receive a yarn comprised of the base fiber from a creel. The yarn is then drawn over another roll and into a texturizing jet which includes a stuffer tube and an energy tube where it is subjected to high temperature and high speed steam. Preferably, the steam forced into the energy tube is arriving at a temperature of 315°–350° C. and a pressure of 65–80 psig. The yarn then passes over a shake out ladder, onto another set of rolls, and is separated into two ends. These ends of base fiber then are commingled via an air jet with the binder fiber which has come off a separate creel. The commingled yarn comprised of base fiber and binder fiber is led over guides to a winder to form a package. During the commingling the base fiber and the binder fiber are travelling at speeds of at least 1500 ft/min and, therefore, it is important that the binder fiber unwind smoothly from the creel and commingle fully with the base fiber. Since the binder fiber of the invention has reduced adhesion it has a reduced tendency to stick to the creel and to the base fiber upon initial contact with the base fiber.

By selection of various component ratios for the thermally activated binder fiber it is possible to modify end-use properties of the finished carpet to improve wear resistance, resilience, reduced change of appearance over time and with use, and increased hand, luster and apparent value. Denier per filament, cut length, fiber cross-section, crimp type and frequency, surface finish, melt viscosity, softening point, melting point, dye affinity, and other properties are crucial to achieving ideal properties in the final product. A proper selection of component ratios and terminators of the binder fiber may be made to obtain the desired, or optimum results from the finished carpet product. This will depend on numerous factors including the denier, length, crimp, finish, and other properties of the base fiber product.

With the utilization of this invention, twist setting conditions normally used are sufficient to activate the binder fiber, to create bind points which strengthen the final product, thereby imparting other characteristics which are desirable. In other words, standard heat conditions for twist setting yarn, such as in the Suessen or Superba processes, will cause the binder fiber to melt sufficiently so that it loses its structural identity as a fiber and is capable of flowing. The molten copolyamide from the binder fiber will flow to intersecting points of base fiber and upon subsequent cooling will encapsulate and bond intersecting points of the base fiber. For example, in the Suessen process, under relatively low humidity conditions compared to the Superba process, the twisted yarn is subjected to a temperature of 190°–205° C. for a residence time of 50–60 seconds. In the Suessen process motion of the fiber while in the relaxed state, caused by vibration or air currents, sufficiently induces the molten binder fiber to flow to the intersecting "touch points" of the base fiber, as a function of the melt flow properties of the binder fiber and surface characteristics. As the fiber emerges from the elevated temperature condition, the binder solidifies and encapsulates or bonds two or more base fibers together at intersecting points in a durable bond.

Subsequent processing including dyeing, finishing, and back coating using commercial processing methods does not soften the bond points sufficiently to weaken them, but rather will strengthen them. The resultant carpet can be of many forms, but a typical style would be cut-pile carpet with about 40 ounces per square yard of face yarn including the binder, with an attached backing. Carpet construction would be typically 5/32" gauge, 3/4" pile height, and the carpet would be dyed, dried, back coated, and sheared using normal processing techniques. The yarn of the invention would also provide important property improvements in the production of loop-pile carpet.

The base fiber could be those nylon fibers that display the appropriate characteristics for use in carpeting. Predominant among these are nylon 6, nylon 66. Although other polyamide and polyester fibers could be used, they tend to be prohibitively costly with no improvement of any consequence in properties. Therefore the preferred base fiber is polyester, nylon 6 and nylon 66 (from hexamethylene diamine adipate salt) Nylon fibers are the most preferable since they are compatible with the claimed binder fiber.

The binder fiber of choice is a copolyamide comprising nylon 6/66 terminated with stearic acid. Other components or precursors for making the copolyamide such as the salt of hexamethylenediamine and any one of dodecanedioic acid, azelaic acid or sebacic acid may be added or substituted for the caprolactam and the hexamethylene diamine adipate. However, the nylon 6/66 copolymer is the most attractive from a standpoint of both economics and efficacy.

The nylon 6/66 is derived from approximately 60 to 85 wt. % caprolactam and 15 to 40 wt. % hexamethylene diamine adipate. In the case of nylon 6/66/612, the concentrations are 50 to 85 wt. % caprolactam, 0 to 40 wt. % hexamethylene diamine adipate and 10 to 50 wt. % hexamethylenediamine dodecanedioate. The primary consideration here is to find a polyamide fiber which is economic, compatible with the base fiber so as to enable it to adhere thereto and capable of being activated, i.e., melted at the temperatures normally found in conventional heat setting apparatus such as Superba and Suessen.

The chain terminators include long chain fatty acids having at least 14 carbon atoms, such as stearic acid and behenic acid. These additives also include salts of these fatty acids, higher alkyl amines and higher alkanoyl amines having boiling points greater than 200° C. Also, instead of using a long chain fatty acid such as stearic acid, a long-chain fatty amine such as stearylamine or other such high molecular weight alkyl amine could be used, with the possible added advantages of providing better adhesion to the substrate after it has melted while in contact with a non-melting substrate. About 0.5 to 2.5 wt. % of the terminators should be added to the mixture of copolymer components. The terminators perform 2 functions: 1) they act to slow down and terminate the copolymerization reaction after a certain point and 2) at the same time they prevent the stickiness and clumping together of the chips as well as adherence of the filaments which is experienced with making these copolyamides from less than 85 wt. % caprolactam.

The base fiber can also include additives such as light stabilizers, flame retardants, pigments, optical brighteners, antistatic agents, surfactants and soil release agents. The binder fiber typically does not include such additives.

Comparative Example 1

1112 grams of caprolactam were mixed with 200 grams of deionized water and melted in a 2-liter glass beaker on a hot plate at 90° C. To the melt was added 497 grams of hexamethylenediamine adipate, also called 6,6 salt. The mixture was stirred until the 6,6 salt was dissolved. 4.4 grams of acetic acid were added. Prior to this invention, acetic acid typically was used as the chain terminator. Then 0.10 grams of 50% aqueous hypophosphorous acid was added. Its function was as a polymerization catalyst. This solution was poured into a 3-liter resin flask equipped with a heating mantle and an agitator. The initial temperature of the flask was 90° C. Over a period of one and a half hours the flask and its contents were heated to 255° C. with agitation and with a nitrogen blanket. After two hours at 255° C., the contents of the flask were at the desired viscosity as measured by the current drawn by the agitator motor, and the agitation was stopped. After fifteen minutes the polymer was extruded out the bottom of the resin flask.

The single strand was quenched in a six foot long trough filled with ice water, and fed to a pelletizer. The extrusion rate and the pelletizer speed were controlled in order to get pellets about 0.1" in diameter and 0.1" long. The pellets were collected in a one gallon glass bottle. At the end of extrusion, the pellets in the glass bottle had clumped together. The clump could be broken apart by hand, but it would not break up without effort. The polymer was given three two-hour washes at 60° C. to remove residual monomer. The polymer had a solution viscosity in formic acid of 35, with 72 equivalents of carboxyls and 22 equivalents of amines per million grams.

Inventive Example 1

The batch of Comparative Example 1 was repeated, but using 20.3 gram of stearic acid instead of 4.4 grams of acetic acid as the chain terminator or molecular weight regulator. The time of polymerization was three and three quarter hours. The polymer was extruded from the bottom of the reactor just as in the previous example and pelletized. The pellets, however, did not stick together and form clumps, but were gathered as individual pellets and handled easily. This polymer was also given three two-hour washes at 60° C. to remove residual monomer. This polymer had a solution viscosity in formic acid of 34, with 76 equivalents of carboxyls and 20 equivalents of amines per million grams.

After washing and drying, the nylon copolymer terminated with stearic acid is conveyed to a grid melter for spinning. (The grid melter is described in "Man-made Fibers" by R. W. Moncrieff, published by Newnes-Butterworth, 6th edn., 1975, page 342.) The melt pool, at 240° C., is blanketed with nitrogen. The melt is metered through a gear pump, at about 30 pounds per hour, to a spinnerette having twelve round orifices, each 0.45 mm. in diameter and 1.25 mm. in length.

The molten polymer is forced through these holes into air at about 20° C. The filaments which are formed are stretched as they solidify until they are taken up on a winder at about 4000 meters per minute. The yarn taken up has a total denier of 30, with twelve filaments. The yarn taken up forms a package of about four pounds.

Comparative Example 2—Procedure for a Copolymer of Nylon 6 with Nylon 6/12.

1032 grams of caprolactam were used with 200 grams of deionized water and melted in a 2-liter glass beaker on a hot plate at 90° C. To the melt was added 371 grams of dodecanedioic acid and 267 grams of a 70% aqueous solution of hexamethylene diamine. The mixture was stirred until all the additives were dissolved. 4.4 grams of acetic acid was added. Its function was to control the molecular weight. Then 0.10 grams of 50% aqueous hypophosphorous acid was added. Its function was as a polymerization catalyst. This solution was poured into a 3-liter resin flask equipped with a heating mantle and an agitator. The initial temperature of the flask was 90° C. Over a period of one and a half hours the flask and its contents were heated to 255° C. with agitation and with a nitrogen blanket. After one and a quarter hours at 255° C., the contents of the flask were at the desired viscosity as measured by the current drawn by the agitator motor, and the agitation was stopped. After fifteen minutes the polymer was extruded out the bottom of the resin flask.

The single strand was quenched in a six foot long trough filled with ice water, and fed to a pelletizer. The extrusion rate and the pelletizer speed were controlled in order to get pellets about 0.1" in diameter and 0.1" long. The pellets were collected in a one gallon glass bottle. The pellets in the glass bottle clumped together. The clumps could be broken apart by hand, but would not break up without effort. The polymer was given three two-hour washes at 60° C. to remove residual monomer. The polymer had a solution viscosity in formic acid of 42, with 70 equivalents of carboxyls and 7 equivalents of amines per million grams.

Inventive Example 2

Comparative Example 2 was repeated using 17.5 grams of stearic acid instead of 4.4 grams of acetic acid as the molecular weight regulator. The time of polymerization was one and one half hours. The polymer was extruded from the bottom of the reactor just as in the previous example and pelletized. The pellets, however, did not stick together and form clumps, but were gathered as individual pellets and handled easily. This polymer was also given three two-hour washes at 60° C. to remove residual monomer. This polymer had a solution viscosity in formic acid of 36, with 79 equivalents of carboxyls and 21 equivalents of amines per million grams. The yarn on the package can be easily stripped from the package. A comparable package of yarn made from the same polymer, but with acetic acid termination rather than stearic acid termination, cannot be easily stripped. The filaments adhere to each other and there is frequent filament breakage.

Comparative Example 3

In a 90 gallon stirred open vessel, heated to 80° were mixed 330 pounds of caprolactam, 96 pounds of deionized water, 147.5 pounds of hexamethylenediamine adipate, 20 grams of 50% hypophosphorous acid, 15 grams of an antifoam, and 640 grams of acetic acid. After all the additives were in solution, it was transferred to an agitated 100 gallon autoclave at 90° C. The autoclave was sealed, purged with nitrogen and heated to 255° C. The autogenous pressure rose to 50 psig. After the reactor had been at 255° C. for one hour, the pressure was vented at the rate of one pound per minute. A vacuum was slowly pulled until the current on the agitator motor reached the desired level. Then the agitation was stopped. After one half hour the polymer was extruded from the bottom of the autoclave in twenty 0.1" diameter strands, and fed into a pelletizer. The rate of extrusion and the rate of pelletization were adjusted to give pellets about 0.1" long. The pellets were dropped into a 40 gallon fiber board drum. The pellets formed clumps which were difficult to break up. Occasionally the pellets clumped in the chute out of the pelletizer and jammed the pelletizer.

Inventive Example 3

Comparative Example 3 was repeated, but instead of using 640 grams (10.66 gram-moles) of acetic acid, 3030 grams (10.66 gram-moles) of stearic acid was used. There was no clumping of pellets after pelletization.

Inventive Example 4

A blend of staple fiber was produced with 3 weight percent of a 70% caprolactam/30% hexamethylenediamine adipate copolymer made according to Inventive Example 1 terminated with stearic acid and having a melt point of 177° C. and 97 weight percent base staple fiber (Allied Type 520 nylon-6 fiber having a melt point range of 215°–225° C.).

The blended fiber was carded, pinned and spun into a singles yarn by conventional processing methods. The yarn, a 3's cotton count yarn containing 4.7 "Z" twists per inch, was plyed with a similar yarn to produce a 2-ply 3's/2 cotton count 4.7Z×4.0S yarn.

The 2-ply yarn was twist set by a conventional Suessen twist setting process. The yarn was passed through a heated chamber at about 195° C. while in a relaxed condition, with a residence time of about 60 seconds.

Multiple ends of this yarn were tufted into cut pile carpet and conventionally finished to obtain the improved product.

The resulting carpet was compared to a control carpet prepared in the same manner from 100 percent base staple fiber. The carpet containing the binder staple fiber blend displayed enhanced carpet tuft appearance, more resilience, and better wear resistance.

Inventive Example 5

Carpets also may be produced from bulked continuous filament (BCF) yarns, and carpets thus made can be improved in surface, aesthetics, hand, or in durability and wear by using this invention. In the following example the carpet manufacturer simply uses normal processing techniques to obtain the desired effect.

Filament nylon yarn is produced according to various conventional fiber producer manufacturing methods. These methods are not particularly related to the invention, except that another, smaller, filament yarn will accompany a base yarn throughout subsequent process setups. Often the combination will result in a 2-ply, 3-ply, or other form needed for the carpet style.

In various processes, twisting, entangling, or direct cabling may be utilized. Direct cabling is often used, as in this example, where a 70 denier 14 filament yarn is combined with a 1185 denier 70 filament in the creel of the direct cabler to produce a yarn with 3.5 "S" twist per inch in each of the singles and 3.5 "Z" twist in the resultant 2-ply twisted yarn (1185×2 ply). The final yarn contains a third component, a binder yarn, which has a lower melting point and which will lose much of its identity in subsequent process steps, as it is melted and flows to bind fibers and yarn together, thereby retaining the twist in cut pile carpet.

In this example 70 denier copolyamide yarn made by the process of Example 2 having a melt point range of 165°–190° C. is the binder fiber, and 2.8 wt. % of this binder fiber is combined with 2 ends of 1185 denier of nylon 6, resulting in a blend. This ratio can be doubled by using two ends, or varied by providing other denier products to the system.

When the product is subjected to conventional twist setting, the binder is activated producing a final product with the desirable characteristics of enhanced carpet tuft appearance, more resilience, and better wear resistance than similar carpets not containing the binder. The twist setting conditions for this are typically 270° F., in saturated steam, with a residence time of about 60 seconds. As the fiber emerges from the elevated temperature condition, the binder solidifies and encapsulates or bonds two or more base yarns together in a permanent or durable bond.

Multiple ends of these yarns are tufted into cut pile carpet and conventionally finished to obtain the improved product.

Comparative Example 4

A batch was made according to Comparative Example 1, but using 14.3 grams of lauric acid instead of acetic acid as the chain terminator. Pellets made from this batch were extruded at 17.4 g/min through a spinnerette having fourteen round orifices at 227°– 235° C. The resulting filaments are spun drawn through a first roll at about 1200–1300 feet per minute and a second roll at about 3600–3700 feet per minute and then taken up on a winder to form a package. The pellets clumped together causing extrusion problems and it was difficult to unwind the yarn from the winder because of the tendency of the yarn to stick to the package.

From the foregoing description, one skilled in the art can easily ascertain the essential characteristics of this invention, and without departing from the spirit and scope thereof, can make various changes and modifications of the invention to adapt it to various usages and conditions.

I claim:

1. A yarn comprising a blend of at least one base fiber selected from the group consisting of polyester, nylon 6 and nylon 66, and 1–12 weight percent (based upon the weight of the blend) of a heat activated binder fiber having a melting point of about 165° to 190° C. under ambient humidity conditions, said binder fiber comprising a copolyamide which is derived from a mixture of:

(a) 50 to 85 wt. % caprolactam, based upon the weight of the mixture;

(b) 0 to 40 wt. % hexamethylenediamine adipate or a combination of hexamethylenediamine and adipic acid, based upon the weight of the mixture;

(c) optionally, 5 to 50 wt. % of a component selected from the group consisting of hexamethylenediamine dodecanedioate, a blend of hexamethylene diamine and dodecanedioc acid, hexamethylenediamine azeleate, a blend of hexamethylene diamine and azelaic acid, hexamethylenediamine sebacate, a blend of hexamethylene diamine and sebacic acid, hexamethylenediamine terephthalate, and a blend of hexamethylene diamine and terephthalic acid; and (d) a chain terminator selected from at least one of the group consisting of a fatty acid and a fatty amine, wherein said fatty acid or fatty amine includes at least 14 carbon atoms.

2. The yarn of claim 1 wherein the binder fiber has a melting point of 170°–185° C. under ambient humidity conditions.

3. The yarn of claim 1 wherein the copolyamide is derived from a mixture of:

(a) 50 to 85 wt. % caprolactam;

(b) 0 to 40 wt. % hexamethylenediamine adipate; and (c) 10 to 50 % of hexamethylenediamine dodecanedioate or a blend of hexamethylene diamine and dodecanedioc acid.

4. The yarn of claim 1 wherein the copolyamide is derived from a mixture of:

(a) 60 to 85 wt. % caprolactam; and (b) 15 to 40 wt. % hexamethylenediamine adipate.

5. The yarn of claim 1 wherein said binder fiber is a ternary copolyamide of the 6/66/612 type.

6. The yarn of claim 1 comprising 1–8 weight percent binder fiber.

7. The yarn of claim 1 wherein said base fiber is nylon 6.

8. The yarn of claim 4 wherein said base fiber is nylon 6.

9. The yarn of claim 1 wherein said chain terminator comprises stearic acid.

10. A process for production of carpet comprising heating the yarn of claim 1 so that the binder fiber melts sufficiently so that it is capable of flowing, subsequently cooling said yarn to solidify said melted binder fiber, thereby encapsulating and bonding intersecting points of said base fiber, then incorporating the resulting heat-treated yarn into a carpet construction.

11. The process of claim 10 further comprising twist setting of the yarn simultaneously with the heating of the yarn.

12. The process of claim 10 wherein the copolyamide is derived from a mixture of:

(a) 50 to 85 wt. % caprolactam;

(b) 0 to 40 wt. % hexamethylenediamine adipate; and (c) 10 to 50 wt. % of hexamethylenediamine dodecanedioate or a blend of hexamethylene diamine and dodecanedioc acid.

13. The process of claim 10 wherein the copolyamide is derived from a mixture of:

(a) 60 to 85 wt. % caprolactam; and (b) 15 to 40 wt. % hexamethylenediamine adipate.

14. A carpet comprising face fiber produced from a twist set yarn, wherein said yarn comprises:

(a) at least one base fiber selected from the group consisting of polyester, nylon 6 and nylon 66, and (b) 1–12 weight percent (based upon the weight of said yarn) of a heat activated binder fiber which is derived from a mixture of:

(i) 50 to 85 wt. % caprolactam, based upon the weight of the mixture;

(ii) 0 to 40 wt. % hexamethylenediamine adipate or a combination of hexamethylenediamine and adipic acid, based upon the weight of the mixture;

(iii) optionally, 5 to 50 wt. % of a component selected from the group consisting of hexamethylenediamine dodecanedioate, a blend of hexamethylenediamine and dodecanedioc acid, hexamethylenediamine azeleate, a blend of hexamethylenediamine and azelaic acid, hexamethylenediamine sebacate, a blend of hexamethylenediamine and sebacic acid, hexamethylenediamine terephthalate, and a blend of hexamethylenediamine and terephthalic acid; and (iv) a chain terminator selected from at least one of the group consisting of a fatty acid and a fatty amine, wherein said fatty acid or fatty amine includes at least 14 carbon atoms;

said yarn having been heated so that said binder fiber is melted sufficiently so that it is capable of flowing and then cooled to solidify said melted binder fiber material such that intersecting points of said base fiber are bonded by said melted binder fiber material.

15. A carpet of claim 14 wherein component (iii) is present and comprises 10 to 50 wt. % of hexamethylenediamine dodecanedioate or a blend of hexamethylenediamine and dodecanedioc acid.

16. A carpet of claim 14 wherein component (i) comprises 60 to 85 wt. % caprolactam and component (ii) comprises 15 to 40 wt. % hexamethylenediamine adipate.

17. A carpet of claim 14 wherein said binder fiber is a ternary copolyamide of the 6/66/612 type.

18. A carpet of claim 14 wherein said base fiber is nylon 6.

19. A carpet of claim 14 wherein said chain terminator comprises stearic acid.

* * * * *